US009137594B2

(12) United States Patent
Greenwood et al.

(10) Patent No.: US 9,137,594 B2
(45) Date of Patent: Sep. 15, 2015

(54) MICROPHONE UNIT

(71) Applicant: Sennheiser electronic GmbH & Co. KG, Wedemark (DE)

(72) Inventors: Andrew Greenwood, San Francisco, CA (US); Sebastian Chafe, San Francisco, CA (US); Stefan Thien, Surwold (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 13/857,194

(22) Filed: Apr. 5, 2013

(65) Prior Publication Data

US 2014/0301589 A1 Oct. 9, 2014

(51) Int. Cl.
*H04R 1/08* (2006.01)
*H04R 1/46* (2006.01)

(52) U.S. Cl.
CPC ... *H04R 1/08* (2013.01); *H04R 1/46* (2013.01)

(58) Field of Classification Search
CPC ..... H04R 1/08; H04R 1/46; H04R 1/28; H04R 1/2892; H04R 2201/02; H04R 2201/025; H04R 2201/028; H04R 2201/029; H04R 3/00; H04R 3/005; H04R 5/027
USPC ..... 381/87, 118, 334, 335, 361, 366
See application file for complete search history.

(56) References Cited

U.S. PATENT DOCUMENTS 4,741,242 A * 5/1988 Aronstein ..... 84/454
6,424,723 B1 * 7/2002 Jing ..... 381/361
8,121,300 B1 2/2012 LoDuca et al.

* cited by examiner

*Primary Examiner* — Ahmad F Matar
*Assistant Examiner* — Sabrina Diaz
(74) *Attorney, Agent, or Firm* — Frommer Lawrence & Haug LLP

(57) ABSTRACT

A microphone unit is provided which includes a microphone for picking up sound of a unit which sound is to be picked up, a clamping unit having a first end configured to clamp to the unit and a second end for holding the microphone, a contactless vibration sensor configured to detect vibrations of the unit, and an audio gate unit coupled to the output of the microphone and to the output of the contactless vibration sensor as a trigger signal to allow the output of the microphone to be forwarded to an output terminal.

3 Claims, 2 Drawing Sheets

MICROPHONE UNIT

FIELD OF INVENTION

The present invention relates to a microphone unit.

It is noted that citation or identification of any document in this application is not an admission that such document is available as prior art to the present invention.

Microphones are not only used for picking up the sound of a person singing but also for picking up the sound made from instruments. Therefore, microphones are also used to pick up the sounds of drums.

FIG. 1 shows a schematic representation of a drum and a microphone unit for picking up the sound of the drum according to the prior art. The drum 100 comprises a rim 110 and a drum head 120. A microphone holder 200 is attached with its one end 220 to the rim 110 of the drum. A microphone 300 is placed at a further end 210 to pick up the sounds made by the drum. The output of the microphone 300 is forwarded to an audio gate unit 400. The audio gate 400 is provided to ensure that only the sound of the drum and no other environmental sound is picked up by the microphone by switching the microphone on and off. In a practical environment, sound from other drums or from the environment can be picked up by the microphone if it is always activated. If the drum is hit, then typically the sound made by the drum will be louder than any environmental noise. However, for the time when the drum is not hit and the drum does not produce any noise, the signal which is picked up by the microphone will only consist of noise. By means of the audio gate unit 400, the environmental noise as picked up by the microphone can be efficiently removed. The output of the microphone 300 is monitored by the audio gate unit 400 and compared to a threshold value. If the threshold value is not reached, the audio gate unit 400 will not forward the output of the microphone 300 to an output terminal 900. However, if the signal picked up by the microphone 300 exceeds the threshold value, the audio gate unit 400 will forward the output signal of the microphone to the output terminal 900.

In cases where several drums 100 are positioned close to each other each with a dedicated microphone, the sound produced by an adjacent drum may cause the audio gate unit 400 of a drum to be activated erroneously such that the microphone will pick up sounds from adjacent drums.

FIG. 2 shows a schematic representation of a drum and a microphone unit according to the prior art. Such a set up is for example disclosed in U.S. Pat. No. 8,121,300 B1. The set up according to FIG. 2 corresponds to the set up according to FIG. 1. However, in addition, a trigger unit 600 is provided on the surface of the drum head 120 by means of a clamp 500. The clamp 500 comprises a first end 510 for attaching to the rim 110 of the drum and a second end 520 for holding the sensor 600. The sensor 600 is placed directly on top of the drum head 120 and detects any vibrations of the drum head. The output of the vibrational sensor 600 is forwarded via a line 610 to the audio gate unit. The vibrational sensor 600 is therefore used as a side chain input. In other words, the audio gate unit 400 is only activated to forward the output of the microphone 300 to the output terminal 900 if the vibrational sensor 600 detects a vibration of the drum head when the drum head has been hit. In other words, the vibrational sensor 600 is used as a trigger for the audio gate unit 400. By means of the trigger signal from the vibrational sensor 600, the picking up of noise by the microphone 300 is reduced as the output of the microphone 300 will only be forwarded to the output terminal 900 if a vibration of the drum head 120 is picked up by the sensor 600.

It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like; and that terms such as "consisting essentially of" and "consists essentially of" have the meaning ascribed to them in U.S. Patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112, first paragraph) or the EPO (Article 83 of the EPC), such that applicant(s) reserve the right to disclaim, and hereby disclose a disclaimer of any previously described product, method of making the product, or process of using the product.

SUMMARY OF THE INVENTION

It is an object of the invention to provide an improved microphone unit which allows an improved picking up of sound made for example by a drum.

A microphone unit is provided which comprises a microphone for picking up sound of a unit which sound is to be picked up, a clamping unit having a first end configured to clamp to the unit and a second end for holding the microphone, a contactless vibration sensor configured to detect vibrations of the unit as well as an audio gate unit coupled to the output of the microphone and to the output of the contactless vibration sensor as a trigger signal to allow the output of the microphone to be forwarded to an output terminal.

According to an aspect of the invention, the clamp comprises an arm for holding the vibration sensor.

According to a further aspect of the invention, a cable between the vibration sensor and the audio gate unit is arranged in or at the clamp.

The invention relates to the realization that providing a vibrational sensor in direct contact with the drum head will affect the sound of the drum as those areas of the drum head which are in contact with the sensor will not be able to oscillate freely. In addition, one clamp must be provided for the microphone and a second clamp must be provided for the vibrational sensor thus limiting the available space of the drum.

According to the invention, a sensor for triggering the audio gate unit is provided as a contactless sensor for detecting vibrations of the drum head. The contactless sensor can be embodied as an optical sensor and optionally as a laser sensor or laser vibrometer. The contactless sensor can detect any vibrations of the drum head and forward the detected signal representing the detection of vibrations as a trigger signal to the audio gate unit. The audio gate unit can then allow the output of the microphone to be forwarded to the output terminal 900. The contactless sensor can be attached to a dedicated clamp or the contactless sensor can be attached to the clamp for the microphone.

According to an aspect of the invention, the audio gate unit can be integrated into the clamp for the microphone. Accordingly, the contactless sensor as well as the audio gate unit are attached or integrated into the clamp for holding the microphone. In such a case, the wiring between the sensor and the audio gate unit can be provided inside the clamp. This is advantageous as a separate line from the sensor to the audio gate unit which is a line externally of the clamp unit can be avoided.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 3:
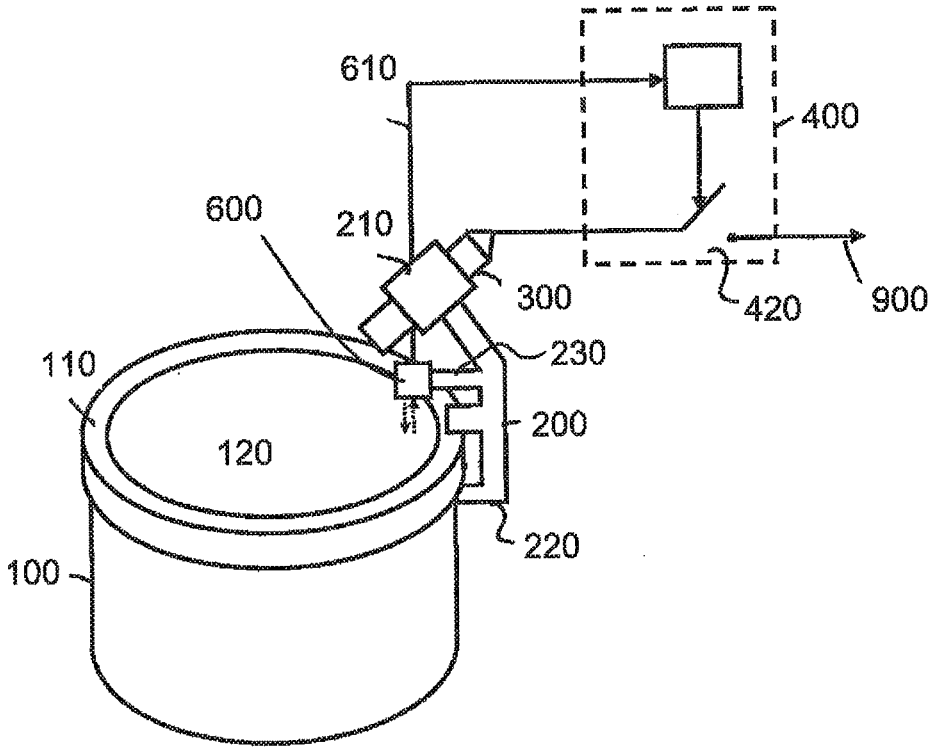
FIG. 3 shows a schematic representation of a microphone unit attached to a drum according to a first embodiment.

FIG. 3 shows a schematic representation of a microphone unit attached to a drum according to a first embodiment. The microphone unit according to the invention is coupled to a drum 100. The drum 100 comprises a rim 110 and a drum head 120. The microphone unit comprises a clamp 200 with a first end 220 for attaching to the rim 110 of the drum 100 and a second end 210 for holding a microphone 300. According to the first embodiment, the clamp comprises an arm 230 for holding a contactless sensor 600. The clamp 200 is designed such that the arm 230 is above the drum head 120 such that the sensor 600 is hold at a distance from the microphone head 220, i.e. the sensor 600 is a contactless sensor.

The microphone unit furthermore comprises an audio gate unit 400 for controlling whether the output of the microphone is forwarded to an output terminal 900. In particular, the output of the microphone 300 is only forwarded to the output terminal 900 if a trigger signal is received from the contactless sensor 600. The contactless sensor 600 is designed to detect vibrations of the drum head. Only if vibrations of the drum head 120 are detected (and exceed a threshold value), then the audio gate unit 400 allows that a switch 420 is closed and that the output of the microphone 300 is forwarded to the output terminal 900.

Figure 1:
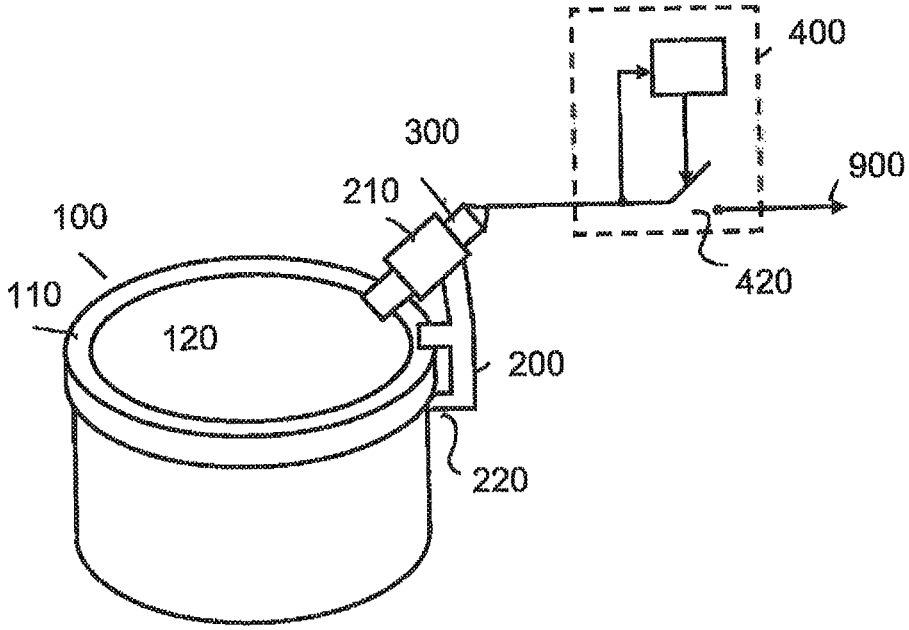
Fig. 1 (Prior Art)
FIGS. 1 and 2 each show a schematic representation of a microphone unit according to the prior art attached to a drum.
Figure 2:
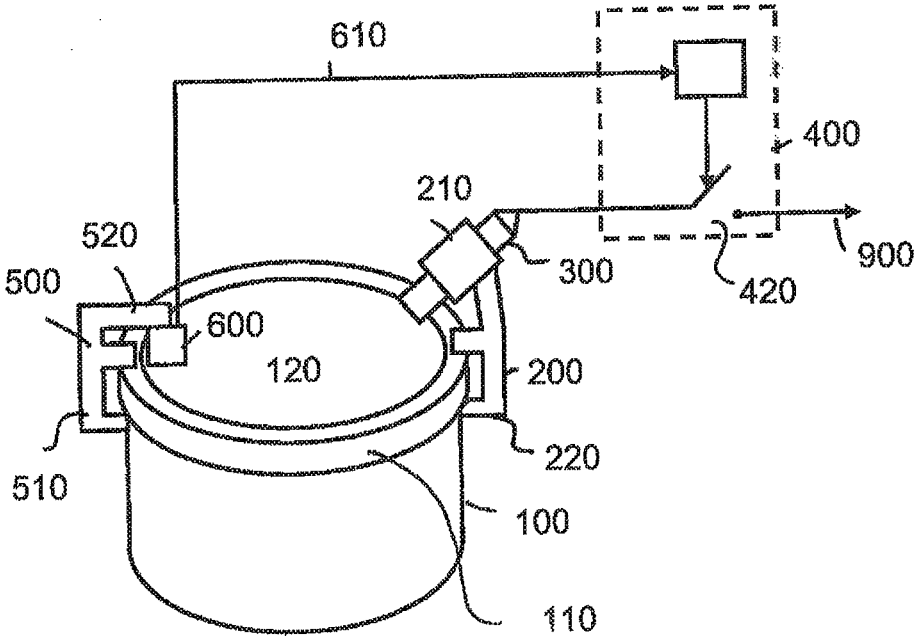
Fig. 2 (Prior Art)

Optionally, the contactless sensor 600 can be clamped (for example as shown in FIG. 2) by dedicated clamp 500 to the rim 110. However, it must be noted that the contactless sensor 600 must be provided at a distance from the drum head 120 to be able to contactlessly detect the vibrations of the drum head 120.

The contactless sensor 600 can be for example an optical sensor, a laser sensor or a laser vibrometer. Such an optical sensor will send out light to the drum head and detect the reflected light for example by means of a light sensitive sensor. This is advantageous as the operation of the sensor 600 will not impact on any vibrations of the drum head and will therefore not have any impact on the original sound of the drum.

Figure 4:
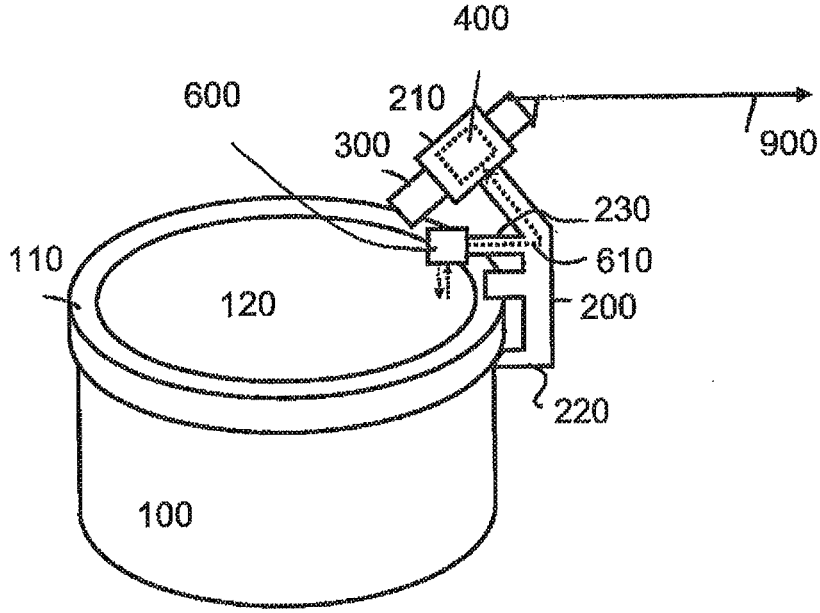
FIG. 4 shows a schematic representation of a microphone unit together with a drum according to a second embodiment.

FIG. 4 shows a schematic representation of a microphone unit together with a drum according to a second embodiment. The microphone unit according to the second embodiment substantially corresponds to the microphone unit according to the first embodiment. The only differences are that the audio gate unit 400 is attached or integrated to the clamp and that optionally the line 610 from the sensor 600 to the audio gate 400 is provided in or at the clamp 200 such that any second external cables are avoided.

According to the invention, the trigger sensor 600 is attached to the clamp 200 which is also holding the microphone thus eliminating the need of a second clamp. This is advantageous as it will greatly increase the accessible area of the drum.

According to the second embodiment, the output of the microphone unit is forwarded to the output terminal 900.

According to a third embodiment, the microphone 300 is implemented as a capacitor type microphone which receives a phantom power supply (according to the P48 standard) as power supply for the microphone. This power supply is typically provided by the recording device attached to the other side of the microphone cable. The power supply for the microphone can also be used as power supply for the sensor 600 and for the audio gate unit 400.

According to a further aspect of the invention, operating elements can be provided at the microphone and/or at the clamp. These operating elements can be used to control or amend the functionality of the audio gate unit 400. In particular, parameters of the audio gate unit (like the threshold value or the release time) can be adjusted by the user via the operating elements.

According to a further aspect of the invention, the parameters of the audio gate unit 400 can be adjusted remotely via the microphone cable. This can for example be done based on the AES 42 standard.

According to this embodiment, the recording device (attached to the other end of the microphone cable) can comprise a user interface for controlling the audio gate unit. After the parameters are selected, the parameters are sent via the microphone cable to the microphone. According to an aspect of the invention, the microphone unit and/or the audio gate unit can comprise a receiver for receiving and decoding such signals.

Relevant parameters for the audio gate unit 400 can be parameters relating to the opening/closing function, the adjustable gain, providing a smooth transition between the opened and the closed condition of the switch 420. The audio gate unit 400 can comprise time constants (attack/release time) for example for controlling the switch such that the switch 420 is still opened a predetermined amount of time after the microphone signal has fallen below a threshold value. As a further example, the output signal of the microphone can undergo an equalization before it is compared to the threshold value. This is advantageous as it can help to prevent that the switch 420 of the audio gate unit opens erroneously as only the frequency that is expected from a specific drum is taken into account for the comparison.

According to the invention, the audio gate unit 400 can be implemented as a method or software.

According to the invention, the microphone unit can be used for detecting vibrations of a drum head of a drum. The microphone unit may, however, also be used in other embodiments.

According to the invention, the vibrational sensor (laser vibrometer) is provided for detecting vibrations of the drum head and use this information in a side chain to the audio gate unit to control whether or not the output of the microphone is forwarded to the output terminal 900. With the microphone unit according to the invention, it is possible to implement a bleed suppression (i.e. an external noise or sound from neighbouring drums).

According to the invention, the trigger sensor 600 can be implemented as an interferometer, an accelerometer, a piezzo electric transducer, video processing, proximity sensing, force sensitive resistors or transmission spectrometers.

According to a further aspect of the invention, the first and second embodiment can also be combined. Here, the external audio gate 400 can be used with the contactless detector 600, wherein the attack/release controls can be integrated into the detector 600. With such an arrangement, a smooth signal can be achieved from the detector. This can still work with the external audio gate and can be compatible with all audio gates because some of them do not have attack/release settings available.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A microphone unit, comprising:

a microphone configured to pick up sound from a sound unit;

a contactless vibration sensor configured to detect vibrations of the sound unit and to output a trigger signal in response to a detected vibration; and a clamp unit comprising:

a first end configured to clamp to the sound unit;

a second end configured to hold the microphone; and an arm configured to hold the vibration sensor; and an audio gate unit which is coupled to an output of the microphone and to an output of the contactless vibration sensor, and which, in response to the trigger signal, allows the output of the microphone to be forwarded to an output terminal of the microphone unit;

wherein the audio gate unit is attached or integrated to the clamp unit;

wherein a cable between the vibration sensor and the audio gate unit is arranged in or at the clamp; and wherein an output terminal of the clamp unit communicates an output of the audio gate unit.

2. A drum accessory unit, comprising the microphone unit according to claim 1.

3. The microphone unit according to claim 1;

wherein the audio gate unit is adapted to be remotely configured via the output terminal of the clamp unit.

* * * * *